US009328974B2

(12) United States Patent
Cizmar et al.

(10) Patent No.: US 9,328,974 B2
(45) Date of Patent: May 3, 2016

(54) PARTICULATE COOLER

(75) Inventors: Lloyd Edward Cizmar, Houston, TX (US); William E. Phillips, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1157 days.

(21) Appl. No.: 13/031,484

(22) Filed: Feb. 21, 2011

(65) Prior Publication Data

US 2012/0211206 A1 Aug. 23, 2012

(51) Int. Cl.

| | |
|---|---|
| ***F28F 9/013*** | (2006.01) |
| ***F28F 9/26*** | (2006.01) |
| ***F28D 7/00*** | (2006.01) |
| ***F28D 7/08*** | (2006.01) |
| *F28D 21/00* | (2006.01) |

(52) U.S. Cl.

CPC ..... *F28F 9/26* (2013.01); *F28D 7/0091* (2013.01); *F28D 7/08* (2013.01); *F28F 9/013* (2013.01); *F28D 2021/0045* (2013.01); *F28D 2021/0075* (2013.01)

(58) Field of Classification Search

CPC ..... F28F 9/013; F28F 9/26; F28D 7/08
USPC ..... 165/164, 165, 157, 163, 162; 122/510
See application file for complete search history.

(56) References Cited

U.S. PATENT DOCUMENTS 1,962,362 A * 6/1934 Reed ..... F28D 7/08 165/161
1,964,256 A * 6/1934 Fahrenwald ..... F24H 1/41 165/135
1,987,116 A * 1/1935 Leach ..... F28F 9/26 165/111
2,013,309 A * 9/1935 Jackson ..... F22D 1/10 122/421
2,355,373 A * 8/1944 Hankison ..... B01D 46/0031 165/163
2,657,473 A * 11/1953 Montgomery ..... F28D 13/00 165/104.16
3,385,271 A * 5/1968 Fleischer ..... B01J 19/0013 122/510

(Continued)

FOREIGN PATENT DOCUMENTS

WO WO 2009/074212 * 6/2009

OTHER PUBLICATIONS

Beckman, Jr, et al, "Rotating Drum Heat Exchanger", Chemical Engineering Communications, 1998, vol. 168, No. 1, pp. 1-11.

*Primary Examiner* — Leonard R Leo
*Assistant Examiner* — Gustavo Hincapie Serna
(74) *Attorney, Agent, or Firm* — Gary Machetta

(57) ABSTRACT

Methods, systems, and apparatus for cooling particulates are provided. The apparatus can include one or more coils at least partially disposed within a cylindrical housing. The one or more coils can include a plurality of tubulars connected by return bends disposed at one or more ends thereof. The apparatus can further include a support grid at least partially disposed within the housing and secured to one or more inner surfaces of one or more sidewalls thereof. The support grid can include a plurality of cross members formed of a series of concentric cylinders connected together by a plurality of radially disposed gussets. An outermost concentric cylinder can be disposed proximate the one or more inner surfaces of the one or more sidewalls, and at least one of the one or more coils can be secured to at least one of the cross members, at least one of the gussets, or both. The support grid can also include one or more beams having a first end and a second end fastened to different points on the one or more inner surfaces of the one or more sidewalls. The cross members can be disposed on at least one of the one or more beams.

11 Claims, 4 Drawing Sheets

(56) References Cited

U.S. PATENT DOCUMENTS

| | | | | | |
|---|---|---|---|---|---|
| 3,991,823 | A * | 11/1976 | Litke | F28D 7/024 165/145 | |
| 4,485,766 | A * | 12/1984 | Worley | F22B 37/202 122/356 | |
| 4,989,669 | A | 2/1991 | Barnes | | |
| 5,109,920 | A * | 5/1992 | Merryfull | B29C 53/083 126/400 | |
| 5,364,457 | A | 11/1994 | Cameron | | |
| 5,515,911 | A * | 5/1996 | Boula et al. | 165/69 | |
| 5,779,994 | A * | 7/1998 | Kupper et al. | 422/618 | |
| 6,233,824 | B1 | 5/2001 | Dobbs et al. | | |
| 6,926,873 | B1 * | 8/2005 | Filippi et al. | 422/198 | |
| 7,597,137 | B2 | 10/2009 | Nelson et al. | | |
| 7,776,287 | B2 * | 8/2010 | Hugues | B01J 8/22 165/145 | |
| RE41,723 | E | 9/2010 | Olson et al. | | |
| 7,832,231 | B2 | 11/2010 | Knight et al. | | |
| 2003/0205135 | A1 | 11/2003 | McNulty | | |
| 2009/0064581 | A1 * | 3/2009 | Nielsen et al. | 48/78 | |
| 2010/0059204 | A1 * | 3/2010 | Stanke et al. | 165/86 | |
| 2010/0132928 | A1 * | 6/2010 | Sutherland | 165/159 | |
| 2010/0313442 | A1 | 12/2010 | Russell et al. | | |

* cited by examiner

PARTICULATE COOLER

BACKGROUND

1. Field

Embodiments described herein generally relate to hydrocarbon processing. More particularly, such embodiments relate to cooling particulates from a gasification process.

2. Description of the Related Art

Raw synthesis gas leaving a gasifier can contain particulates such as coarse ash, fine ash and/or slag that need to be removed prior to further processing. The bulk of the particulates can be removed using a particulate removal system such as filters and/or cyclones. The removed particulates are typically recycled to the gasifier or purged from the system as a byproduct, and the syngas leaving the particulate removal system is further processed and/or purified. The removed particulates, however, typically require cooling before being recycled or purged from the system.

One method for cooling the removed particulates is to drop the hot particulates into a vessel of water and the cooled particulates are then separated from the "dirty" water. This method is not very efficient and only works at low pressures. Another method is to feed the hot particulates to a large horizontally oriented, fluidized bed having cooling coils disposed therein. A large fluidized bed, however, is not easily expanded or contracted to meet the typical cooling requirements of the system. It can also require high energy input to keep particulates flowing through the fluidized bed. And if a portion of the fluidized bed malfunctions, the entire gasification process might have to slow or come to a halt until the fluidized bed cooler can be repaired.

There is a need, therefore, for new apparatus and methods for cooling particulates from a gasification process.

DETAILED DESCRIPTION

Methods, systems, and apparatus for cooling particulates are provided. The apparatus can include one or more coils at least partially disposed within a cylindrical housing. The one or more coils can include a plurality of tubulars connected by return bends disposed at one or more ends thereof. The apparatus can further include a support grid at least partially disposed within the housing and secured to one or more inner surfaces of one or more sidewalls thereof. The support grid can include a plurality of cross members formed of a series of concentric cylinders connected together by a plurality of radially disposed gussets. An outermost concentric cylinder can be disposed proximate the one or more inner surfaces of the one or more sidewalls, and, at least one of the one or more coils can be secured to at least one of the cross members, at least one of the gussets, or both. The support grid can also include one or more beams having a first end and a second end fastened to different points on the one or more inner surfaces of the one or more sidewalls. The cross members can be disposed on at least one of the one or more beams.

Figure 1:
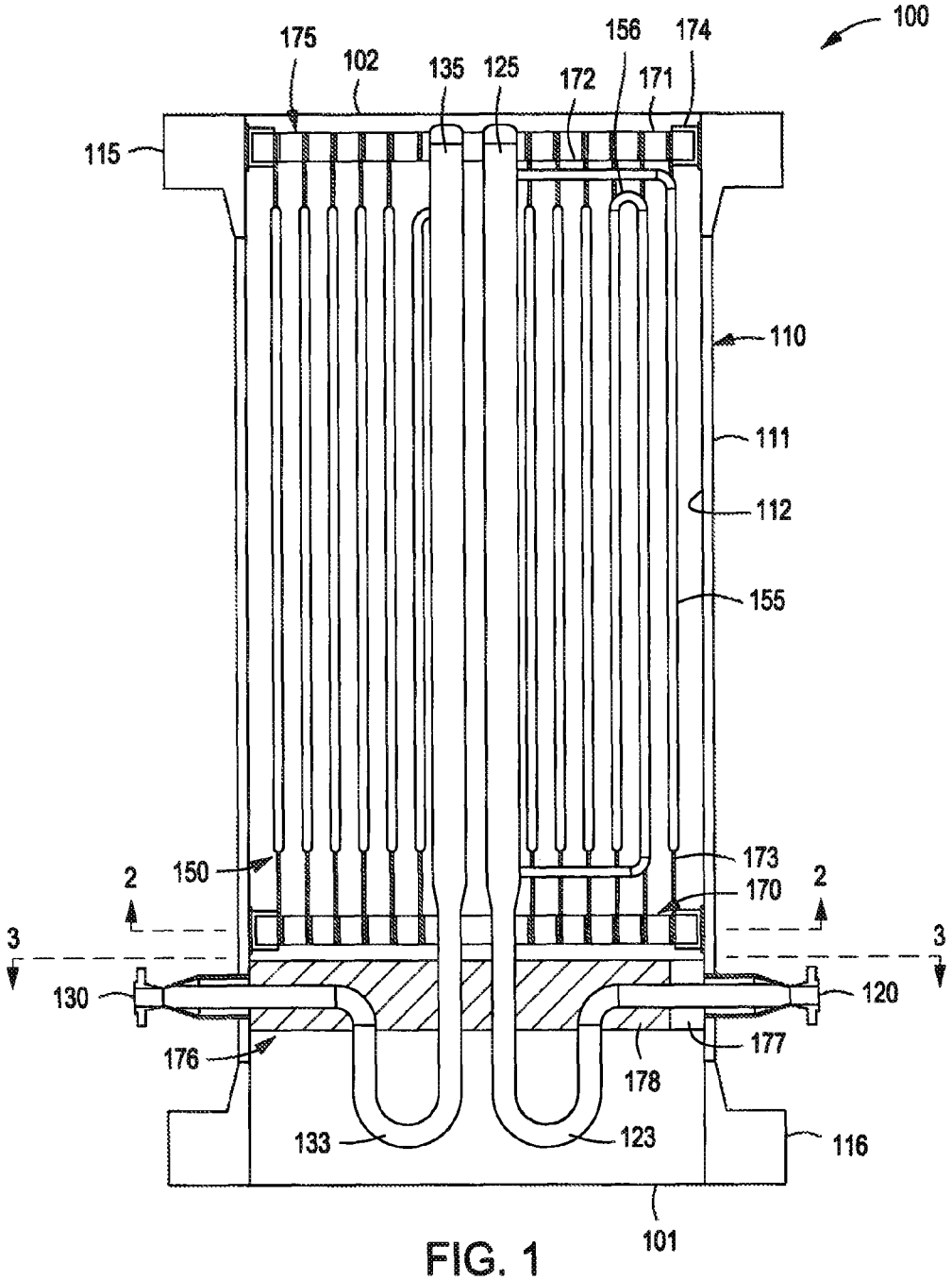
FIG. 1 depicts a cross-sectional view of an illustrative heat exchanger, according to one or more embodiments described.

FIG. 1 depicts a cross-sectional view of an illustrative heat exchanger 100, according to one or more embodiments. The heat exchanger 100 can include a housing 110, one or more inlet manifolds 125, one or more outlet manifolds 135, one or more heat exchange members or coils 150, and one or more supports (three are shown 170, 175, 176). The housing 110 can have an inlet 120 and an outlet 130 disposed in or on one or more sidewalls (one is shown 111) of the housing 110. The inlet 120 can be connected to a coolant supply (not shown) and adapted to receive coolant therethrough. For example, cold water can be supplied to the inlet 120 from a cold water source, another heat exchanger, or a combination thereof. Suitable coolants can include, but are not limited to, water, air, liquid hydrocarbons, gaseous hydrocarbons, or any combination thereof. Heated coolant can be recovered via the outlet 130. For example, heated water can flow through the outlet 130 to one or more steam drums, economizers, or the like. The coolant can be a cooling medium when the heat exchanger 100 is functioning as a cooler and can be a heating medium when the heat exchanger 100 is functioning as a heater.

The housing 110 can have a plurality of shapes, including, but not limited to, a cube, a rectangular box, a cylinder, a triangular prism, a hyperboloid structure, or some other shape or combination thereof. As shown, the housing 110 can be cylindrical.

The housing 110 can have a first or "upper" end or opening 102 and a second or "lower" end or opening 101. The first end 102 can be adapted to receive particulates, e.g., ash, and the second end 101 can be adapted to dispense or convey the particulates therefrom received at the first end 102. The second end 101 and the first end 102 of the housing 110 can be uniform and/or complimentary to facilitate connection of the heat exchanger 100 to another heat exchanger (not shown), another device (e.g., an inlet valve or port), or another part of a system (e.g., a reactor or a processing unit), or any combination thereof. The second end 101 can have a same or similar cross-sectional shape and size as the first end 102. For example, the second end 101 and the first end 102 can both have a circular cross-section of the same or substantially the same diameter. In another example, the second end 101 and first end 102 can both have matching polygonal shapes, including, but not limited to, rectangular, triangular, square, pentagonal, hexagonal, star shaped, or the like. As used herein, the terms "up" and "down;" "upward" and "downward;" "upper" and "lower;" "upwardly" and "downwardly;" "above" and "below;" and other like terms refer to relative positions to one another and are not intended to denote a particular spatial orientation since the apparatus and methods of using the same can be equally effective at various angles or orientations, whether horizontal, vertical, or any angle therebetween.

The housing 110 can include one or more flanges (two are shown 115, 116) at the first and second ends 102, 101 respectively. The flanges 115, 116 can facilitate connection of the heat exchanger 100 to another system (e.g., a gasifier or reactor), another device (e.g., an inlet valve or port), another heat exchanger, or any combination thereof. For example, one or more fasteners (not shown) can be disposed on and/or through the flanges 115, 116 to further connection to another object. Suitable fasteners can include, but are not limited to, bolts, latches, screws, rivets, pins, threads, welds, or any combination thereof.

The inlet manifold 125 can be at least partially disposed within the housing 110 and can be in fluid communication, with the inlet 120. For example, the inlet manifold 125 can be joined to or in fluid communication with the inlet 120 via an inlet tube or inlet pipe 123. The outlet manifold 135 can also be at least partially disposed within the housing 110 and can be in fluid communication with the outlet 130. For example, the outlet manifold 135 can be joined to the outlet via an outlet tube or outlet pipe 133. The inlet tube 123 and the outlet tube 133 can be curved, as shown, to allow for expansion and contraction due to changes in pressure and/or temperature. Alternatively, the inlet tube 123 and the outlet tube 133 can be substantially straight (not shown). The inlet manifold 125 and the outlet manifold 135 can be disposed toward a center or central longitudinal axis of the housing 110, as shown, or can be disposed closer to the sidewall 111 of the housing.

The coil 150 can be at least partially disposed within the housing 110 and can be in fluid communication with the inlet and outlet manifolds 125, 135. The coil 150 can be disposed at least partially around or about the inlet and/or outlet manifolds 125, 135. For example, the coil 150 can be disposed between the inlet and outlet manifolds 125, 135 and the sidewall 111 and/or on either side of the inlet and outlet manifolds 125, 135.

The coil 150 can include one or more tubulars 155. For example, each coil 150 can have a plurality of tubulars 155 connected at first or "upper" ends and/or second or "lower" ends thereof by return bends 156. The tubulars 155 can be axially oriented with respect to a longitudinal axis of the housing 110 and/or can be substantially straight. The substantially straight length of the tubulars 155 can be optimized to reduce or avoid vibration in the cod 150 and/or to facilitate maintenance of the coil 150. For example, the straight length of the tubulars 155 can range from a low of about 1 meter to a high of about 3 meters. The return bends 156 can be "U"-shaped and can direct coolant flow between two adjacent tubulars 155.

The tubulars 155 of the coil 150 can be spaced apart from one another to reduce or prevent bridging of particulates therebetween. For example, the tubulars 155 can be spaced about 50 mm, about 70 mm, about 100 mm, about 120 mm, about 140 mm, or about 160 mm or more apart to reduce or prevent bridging of particulates therebetween. The particular distance between the tubulars 155 can be based, at least in part, on the particular size of the particulates that can be or are expected to be conveyed through the heat exchanger 100.

A first or "lower" support 170 and/or a second or "upper" support 175 can be at least partially disposed within the housing 110. The first support 170 and/or the second support 175 can be fixed, attached, connected, secured, or otherwise disposed on the sidewall 111 of the housing 110 and can be connected or otherwise disposed on at least one of the coils 150. For example, the first support 170 and/or the second support 175 can be removably disposed or permanently disposed on the sidewall 111 and/or at least one of the coils 150. The first support 170 and/or the second support 175 can each include one or more gussets 171 and/or one or more cross members 172 that can form or provide a support grid. The first support 170 and/or the second support 175 can include support pins or rods 173 that can join or connect one or more of the return bends 156 or the tubulars 155 to at least one of the gussets 171 and/or at least one of the cross members 172. For example, each return bend 156 can have one or more support rods 173 disposed thereon or otherwise secured thereto, and each support rod 173 can be disposed on or otherwise secured to either one of the gussets 171, one of the cross members 172 of the supports 170, 175, or both. The support rods 173 can have one end welded to the gussets 171 and/or the cross members 172 and can have an opposite end welded to one of the return bends 156 in the coil 150 to provide support.

The inlet and outlet manifolds 125, 135 can be disposed proximate or adjacent a center of the first support 170 and/or the second support 175. For example, the inlet and outlet manifolds 125, 135 can be secured to a central portion of the first support 170, the second support 175, or both. The inlet manifold 125 and/or outlet manifold 135 can be secured the first support 170, the second support 175, or both using any suitable fastener or combination of fasteners. For example, the inlet and outlet manifolds 125, 135 can be secured the first support 170, the second support 175, or both with a combination welded/bolted attachment that allows for differential expansion between the inlet and outlet manifolds 125, 135. As shown, the inlet and outlet manifolds 125, 135 can be disposed through the grid of the first support 170. The inlet and outlet manifolds 125, 135 can also be disposed through or disposed on the second support 175.

At least one of the gussets 171 and/or the cross members 172 can be disposed proximate or adjacent an inner side or surface 112 of the sidewall 111 of the housing 110. For example, at least two gussets 171 can be connected or attached to one or more grid clips 174 disposed on the sidewall 111, as shown. In another example, the gussets 171 and/or cross members 172 can be removably fastened to the grid clips 174 by one or more fasteners (not shown). Suitable fasteners can include, but are not limited to, bolts, hooks, latches, screws, rivets, pins, threads, or any combination thereof. In yet another example, at least one of the gussets 171 and/or the cross members 172 can be directly fastened to the inner surface 112 of the sidewall 111.

A third or "beam" support 176 can be disposed proximate the first support 170. For example, the beam support 176 can be disposed below the first support 170 to help or assist the first support 170 bear a weight of the coil 150 and the inlet and outlet manifolds 125, 135. The beam support 176 can also improve the structural integrity of the heat exchanger 100. The beam support 176 can also help reduce or alleviate forces caused by drag coefficient. The beam support 176 can include one or more beams 178 and can be fastened to the sidewall 111 of the housing with one or more beam clips 177. Each beam 178 can have a first end and a second end disposed at different points on the inner surface 112 of the sidewall 111 of the housing 110. The beam clips 177 can be disposed on and/or fastened to the inner surface 112 of the sidewall 111 and can be disposed on and/or fastened to at least one of the beams 178. For example, the beam clips 177 can be welded to the inner surface 112 of the sidewall 111. The beams 178 can be disposed on the beam clips 177 and/or can be disposed directly on the inner surface 112 of the sidewall 111. For example, at least one end of each beam 178 can be removably fastened to a corresponding beam clip 177. Suitable fasteners can include, but are not limited to, bolts, hooks, latches, screws, rivets, pins, threads, or combinations thereof. All or at least a portion of supports 170, 175, 176, coils 150, and inlet and outlet manifolds 125, 135 can be removable from the housing 110 for repair or replacement.

The housing 110 and any of one or more parts or components therein can be made from suitable metals, metal alloys, composite materials, polymeric materials, or the like. For example, the housing 110, including the inlet 120 and outlet 130, can be composed of carbon steel or low chrome steel, and the internals, i.e., the coil 150, the manifolds 125, 135, and the inlet and outlet pipes 123, 133, can be composed of stainless steel.

In operation, the heat exchanger 100 can receive particulates, e.g., ash, through the first end 102. A coolant, e.g., water, can be introduced to the inlet 120 disposed in the sidewall 111 of the housing 110 prior to the particulates entering the first end 102 or simultaneously. Although not shown, an external vessel can supply coolant to the inlet 120 and/or receive coolant from the outlet 130 via external piping, where the external piping is in fluid communication with the inlet 120 and/or the outlet 130. The coolant can pass from the inlet 120, through the inlet tube 123, to the inlet manifold 125. The inlet manifold 125 can distribute the coolant to the tubulars 155 and bends 156 of the coil 150. The coolant can then flow from the coil 150 to the outlet manifold 135, through the outlet tube 133, and out through the outlet 130 disposed in the sidewall 111 of the housing 110.

The particulates can pass from the first end 102 between the tubulars 155 and bends 156 of the coil 150. As the particulates flow through the heat exchanger 100, heat can be indirectly transferred to the coolant to produce cooled particulates and heated coolant. The heated coolant can be recovered from the outlet 130 of the heat exchanger 100 and fed to another part of a system or process, e.g., steam drums and/or economizers.

The coolant can be introduced to the inlet 120 at any desired pressure. For example, the coolant can enter the inlet 120 at a pressure matching the pressure in the heat exchanger 100. This can help maintain the coolant at a desired velocity and/or reduce boiling of the coolant flowing through the coil 150, the inlet and outlet manifolds 125, 135, and/or the inlet and outlet tubes 123, 133. For example, a sufficient amount of coolant can flow into the inlet 120 such that the coolant does not vaporize within the coil 150. In another example, less than about 30%, less than about 20%, less than about 10%, less than about 5%, less than about 2%, or less than about 1% of the coolant flowing into the inlet 120 can be vaporized. The coolant can enter the inlet 120 at a pressure ranging from a low of about 101 kPa, about 150 kPa, about 350 kPa, or about 700 kPa to a high of about 3,500 kPa, about 6,900 kPa, about 13,800 kPa, or about 20,000 kPa. The coolant can enter the inlet 120 at a temperature ranging from a low of about 15° C., about 30° C., about 60° C., about 90° C. to a high of about 175° C., about 250° C., about 300° C., or about 350° C. In another example, the coolant can enter the inlet 120 at a temperature of from about 38° C. to about 335° C., about 45° C. to about 275° C., or about 75° C. to about 200° C. Although pressure ranges and temperature ranges are indicated, the pressure and temperature of the cooling can vary widely depending on the pressure and temperature of particulates traveling through heat exchanger 100. The coolant recovered from the outlet 130 can have an increased temperature compared to the temperature of the coolant entering through the inlet 120. For example, the coolant recovered from the outlet 130 can have a temperature ranging from a low about 0.5° C., about 1° C., about 5° C., or about 10° C. to a high of about 50° C., about 100° C., about 150° C., or about 200° C. more than the temperature of the coolant entering through the inlet 120.

Illustrative particulates can include, but are not limited to, coarse ash particles, fine ash particles, sand, ceramic particles, catalyst particles, fly ash, slag, or any combination thereof. As such, the particulates can be produced, used in, or otherwise recovered from any number of hydrocarbon processes. For example, the particulates can be produced, used in, or otherwise recovered from a gasification process, a catalytic cracking process such as a fluidized catalytic cracker, or the like. Suitable gasification processes can include one or more gasifiers. The one or more gasifiers can, be or include any type of gasifier, for example, a fixed bed gasifier, an entrained flow gasifier, and a fluidized bed gasifier. In at least one example, the gasifier can be a fluidized bed gasifier.

As used herein, the terms "fine ash" and "fine ash particles" are used interchangeably and refer to particulates produced within a gasifier and having an average particle size ranging from a low of about 35 micrometers (μm), about 45 μm, about 50 μm, about 75 μm or about 100 μm to a high of about 450 μm, about 500 μm, about 550 μm, about 600 μC, or about 640 μm. For example, coarse ash particulates can have an average particle size of from about 50 μm to about 350 μm, about 65 μm to about 250 μm, about 40 μm to about 200 μm, or about 85 μm to about 130 μm. As used herein, the terms "fine ash" and "fine ash particles" are used interchangeably and refer to particulates produced within a gasifier and having an average particle size ranging from a low of about 2 μm, about 5 μm, or about 10 μm to a high of about 75 μm, about 85 μm, or about 95 μm. For example, fine ash particulates can have an average particle size of from about 5 μm to about 30 μm, about 7 μm to about 25 μm, or about 10 μm to about 20 μm.

Figure 2:
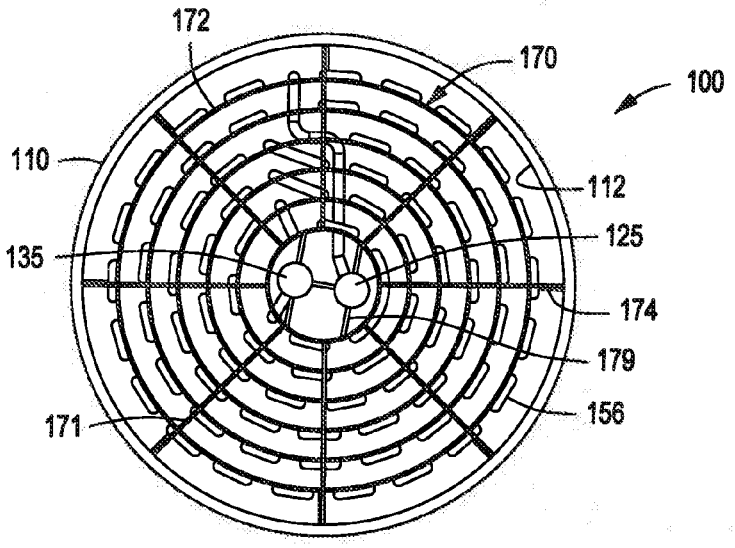
FIG. 2 depicts a cross-section view of the heat exchanger depicted in FIG. 1 along line 2-2.

FIG. 2 depicts a cross-section view of the heat exchanger 100 depicted in FIG. 1 along line 2-2. The housing 110 of the cooler 110 can have a polygonal shape, including, but not limited to, a rectangular shape, a triangular shape, a square shape, a pentagonal shape, a hexagonal shape, star shape, etc. For example, the housing 110 can have a circular cross-section, as shown. The housing 110 can have the same shape or a different shape from the second end 101 and the first end 102. For example, a middle portion of the housing 110 can have a circular cross-section and the first and second ends 102, 101 can have a square cross-section along the flanges 115, 116.

The first and second supports 170, 175 can have a variety of shapes and sizes. For example, when the housing 110 is cylindrical, as shown, the cross members 172 of the supports 170, 175 can include a series of concentric cylinders connected by a plurality of the gussets 171. Although not shown, the cross member 172 can be straight. Grid clips 174 can be disposed at various locations around the sidewall 111 and the gussets 171 closest to the sidewall 111 of the housing 110 each be connected to one or more grid clips 174. For example, the grid clips 174 can be disposed on or otherwise secured to the inner surface 112 of the sidewall 111. Although not shown, one or more of the cross members 172 can be disposed and/or secured directly to the inner surface 112 of the sidewall 111. For example, an outermost cylindrical cross member 172 can be secured to inner surface 112 of the sidewall 111 either directly by a fastener (e.g., a weld or bolt) or via at least one of the grid clips 174. In another example, one or more ends of cross members 172 that are straight (not shown) can be secured to the inner surface 112 of the sidewall 111 either directly by a fastener (e.g., a weld or bolt) or via at least one of the grid clips 174.

The inlet and outlet manifolds 125, 135 can be secured to the first support 170 and/or the second support 175 with one or more plates or gussets 179. The plates 179 can be welded or bolted to one or more of the gussets 171 and/or cross member 172 of the first or second supports 170, 175. The plates 179 can also be disposed directly between the inlet and outlet manifolds 125, 135 and can secure the inlet manifold 125 to the outlet manifold 135. The plates 179 connecting the inlet and outlet manifolds 125, 135 can be joined to the inlet and outlet manifolds 125, 135 to allow for differential expansion between the manifolds 125, 135.

The coil 150 can include a plurality of coils. For example, the coil 150 can have or include an inner coil or "inner, portion" and an outer coil or "outer portion" that are each independently in fluid communication with the inlet and outlet manifolds 125, 135. The inner portion and the outer portion can each have an inlet pipe joined to or in fluid communication with the inlet manifold 125 and an outlet pipe joined to or in fluid communication with the outlet manifold 135 to provide fluid communication between the inner and outer portions and the inlet and outlet manifolds 125, 135. In another example, the coil 150 can include a plurality of separate portions of linked tubulars 155 and bends 156. For a cylindrical housing 110, an outer portion of the coil 150 can be concentrically disposed about an inner portion of the coil 150, and the inner portion of the coil 150 can be concentrically disposed about the inlet and outlet manifolds 125, 135. Multiple portions of the coil 150 can be cooled quickly because the coolant has less distance to travel than in a single large coil. Multiple portions can also help maintain cooling at the certain zones in the coil 150. For example, with coils 150 having the inner and outer portions, coolant traveling through the inlet manifold 125 can be fed to the outer portion at a different rate than the inner portion to help maintain equal cooling temperature across the coil 150, to cool the outer portion of the coil 150 more quickly, or to cool the inner portion of the coil 150 more quickly.

For a cylindrical housing 110, the coil 150 can be made up of a plurality of tubular coils arranged in concentric cylinders or rings. Each tubing coil can have a plurality of vertical tubulars 155 and bends 156. For example, a first ring of tubular coils can have a first diameter of from about 25 cm to about 35 cm and of from about 4 to about 10 tubulars 155. A second ring of tubular coils can have a second diameter of from about 40 cm to about 50 cm and of from about 14 to about 24 tubulars 155. A third ring of tubular coils can have third diameter of from about 55 cm to about 65 cm and can have of from about 20 to about 26 tubulars 155. A fourth ring of tubular coils can have a fourth diameter of from about 70 cm to about 80 cm and of from about 27 to about 33 tubulars 155. A fifth ring of tubular coils can have fifth diameter of from about 85 cm to about 95 cm and can have of from about 32 to about 40 tubulars 155. A sixth ring of tubular coils can have sixth diameter of from about 100 cm to about 110 cm and can have of from about 38 to about 48 tubulars 155.

For the cylindrical housing 110, the inner portion of the coil 150 can include, but is not limited to, one, two, three, four, or more rings of tubular coils and the outer heat exchanger can include, but is not limited to, one, two, three, four, or more rings of tubular coils. The number of tubular coils can depend on the shape and size, especially diameter of the housing 110. For example, the inner portion of the coil 150 can include the first through fourth rings of tubular coils and the outer portion of the coil 150 can include the fifth and sixth rings of tubular coils. In another example, the inner portion of the coil 150 can include the first through third rings of tubular coils and the outer portion of the coil 150 can include the fourth through sixth rings of tubular coils.

Figure 3:
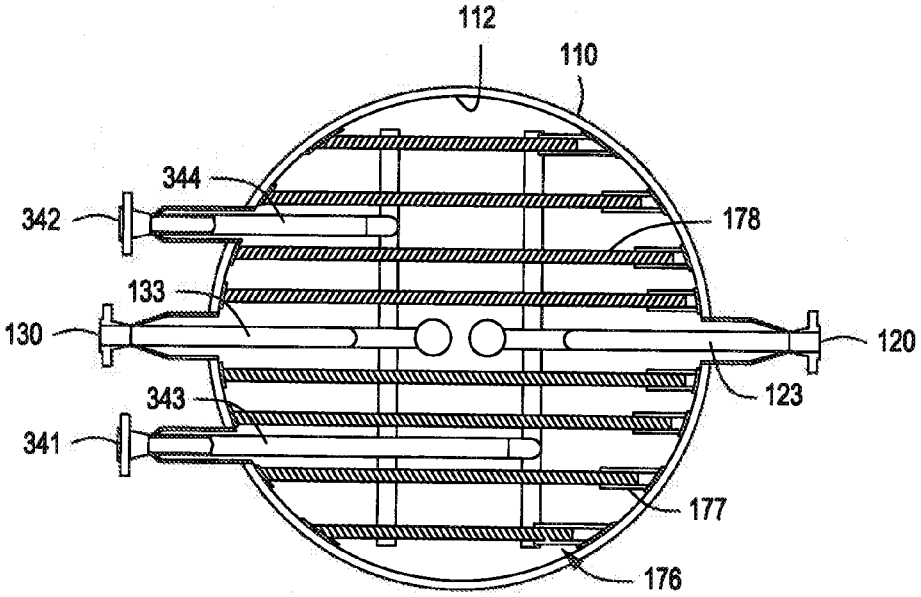
FIG. 3 depicts another cross-section view of the heat exchanger depicted in FIG. 1 along line 3-3.

FIG. 3 depicts a cross-section view of the heat exchanger 100 depicted in FIG. 1 along line 3-3. As shown, the housing 110 can further include one or more aeration nozzles (two are shown 341, 342) disposed thereon or otherwise secured thereto. The aeration nozzles 341, 342 can be in fluid communication with one or more aeration tubes (two are shown 344, 343). The aeration nozzles 341, 342 can provide start-up or "fluff" air to get air or fluid flowing in the heat exchanger 100. The one or more aeration tubes 343, 344 can extend into the housing 110 to control the location of air added to the particulate cooler 100. The one or more aeration tubes 343, 344 can be disposed between beams 178 of the beam supports 176.

The aeration nozzles 341, 342 can supply one or more fluids, e.g., "fluff" air and/or other gases such as nitrogen, to the inside of the housing 110 to get the air and/or other gases flowing through the heat exchanger 100. Particularly during startup, gas can be supplied or introduced to the aeration nozzles 341, 342 to create a gas current through the heat exchanger 100 and thereby draw particulates through gaps in the bends 156 and/or tubulars 155 of the coil 150.

One or more beam supports 176 having one or more beams 178 of differing lengths can be disposed within the housing 110. The beam(s) 178 can be arranged parallel to one another to allow other parts of the assembly, e.g., the aeration nozzles 343, 344, the inlet tube 123, and/or the outlet tube 133. As discussed and described above, each beam support 176 can include the one or more beams 178 and/or one more beam clips 177. The beam(s) 178 can be secured directly to the sidewall 111 of the housing 110 and/or can be joined to the sidewall 111 via the beam clip(s) 177. For example, one or both ends of the beam(s) 178 can be permanently or removably secured directly to the sidewall 111. In another example, one or both ends of the beam(s) 178 can be joined to the sidewall 111 via the beam clip(s) 177.

Figure 4:
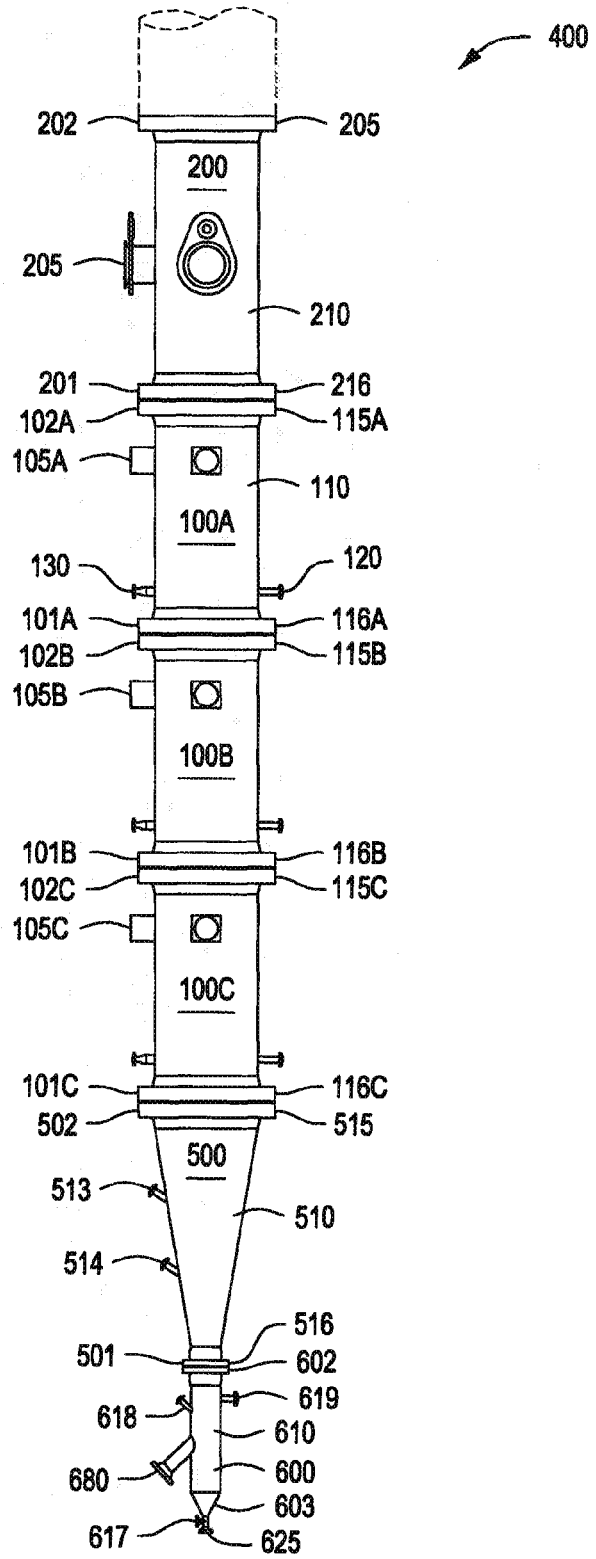
FIG. 4 depicts a side view of an illustrative heat exchange system, according to one or more embodiments described.

FIG. 4 depicts a side view of an illustrative heat exchange system 400, according to one or more embodiments. The heat exchange system 400 can include one or more particulate inlet ports, gravity drops, or couplers 200, one or more heat exchangers (three are shown 100A, 100B, 100C) one or more first diameter reducers 500, and one or more second diameter reducers 600.

The particulate inlet port 200 can have a housing 210 having a first or "upper" end 202 and a second or "lower" end 201. A first or "upper" flange 215 can be disposed on the first end 202 and a second or "lower" flange 216 can be disposed on the second end 201.

The particulate inlet port 200 can be used as a support for the entire heat exchange system 400. One or more trunnions 205 can be disposed on the housing to support the particulate inlet port 200. The trunnion(s) 205 can aid in moving and interchanging of the particulate inlet port 200 and/or movement of the entire heat exchange system 400. The trunnion(s) 205 can act as a guide train for alignment of the particulate inlet port 200 with other components of the heat exchange system 400. The trunnion(s) 205 can be disposed on or secured to a support structure (not shown) for the heat exchange system 400. The trunnion(s) 205 can be swivel trunnions.

The particulate inlet port 200 can at least partially control the release of particulates, from a system or process, e.g., a gasification system. The first end 202 can be adapted to be disposed on or secured to an outlet of a particulate removal system (not shown), and the second end 201 can be adapted to be disposed on one or more of the heat exchangers 100. The particulate inlet port 200 can control, at least in part, the level and flow of particulates through the heat exchange system 400. For example, the particulate inlet port 200 can have one or more valves that regulate particulate flow into and/or through the heat exchange system 400, e.g., one or more slide valves, one or more rotating disc valve, or any combination thereof. In another example, the rate of particulate flow into the particulate inlet port 200 and/or through the entire heat exchange system 400 can be controlled by pneumatic pressure differences before and/or after the heat exchange system 400 that can push particulates into the particulate inlet port 200 or draw particulates through the heat exchange system 400. Although not shown, the particulate inlet port 200 can be a hollow cylinder having one or more sensors disposed therein or thereabout. For example, the particulate inlet port 200 can have capacitance probe disposed therein and/or a nuclear sensor disposed thereabout for measuring the flow rate of particulates into the particulate inlet port 200. The valve(s) and/or the pressure difference can be adjusted based on the sensed flow rate of the particulates to increase or decrease the flow of particulates into the heat exchange system 400. In another example, particulates from a system or process can be fluidized with one or more gases prior to their introduction to the particulate inlet port 200. The rate of particulate introduction to the particulate inlet port 200 can be controlled, for example, by increasing, reducing, or terminating the fluidization of the particulates.

A plurality of heat exchangers 100 can be joined to the particulate inlet port 200. In one or more embodiments, the plurality of heat exchangers 100 can be the same and can be interchangeable with one another. The heat exchangers 100 can be joined in series and/or in parallel (not shown). For example, a first heat first heat exchanger 100A, a second heat exchanger 100B, and a third heat exchanger 100C can be linked in series. While three heat exchangers 100A, 100B, 1000 are depicted, any number of heat exchangers 100 can be linked together and/or interconnected. The linked or joined heat exchangers 100 can form a continuous heat exchange tube or path when linked in series. For example, four or five heat exchangers 100 can be linked in series between the particulate inlet port 200 and the diameter reducers 500, 600. In another example, four heat exchangers 100 can be linked in series and a fifth heat exchanger 100 can be stored as a spare.

As discussed and described above, each heat exchanger 100 can have a second end 101 and a first end 102, with a second flange 116 disposed on the second end 101 and a first flange 115 disposed on the first end 102. Each heat exchanger 100 can have one or more inlets 120 for receiving coolant and one or more outlets 130 disposed in or on a sidewall 111 of a housing 110 for dispensing coolant. Although not shown, each heat exchanger 100 can also have one or more aeration nozzles disposed in or on the sidewall 111 of the housing 110.

One or more trunnions 105 can be disposed on the outside of the sidewall 111 of the housing 110. Like the trunnion(s) 205 on the particulate inlet port 200, the trunnion(s) 105 can provide support for heat exchanger 100. The trunnion(s) 105 can also support other heat exchangers 100 below and/or above. The trunnion(s) 105 can act as a guide train or guide rail for alignment of the heat exchangers 100 with the particulate inlet port 200, other heat exchangers 100, diameter reducers 500, 600, and/or one or more support members (not shown). The trunnions 105 can allow the heat exchanger 100 to be moved and exchanged with another heat exchanger 100. For example, a malfunctioning heat exchanger 100 can be exchanged with a functional spare, at least in part, by connecting moving equipment to one or more of the trunnion(s) 105.

The first heat exchanger 100A can be disposed on or secured to the particulate inlet port 200. For example, a first or "upper" end 102A of the first heat exchanger 100A can be disposed on or otherwise secured to the second end 201 of the particulate inlet port 200. A first or "upper" flange 115A on the first end 102A can be aligned with a second or "lower" flange 216 of the particulate inlet port 200 to aid in fastening of the two parts. For example, one or more fasteners can be used to secure the first flange 115A to the second flange 216. Suitable fasteners can include, but are not limited to, bolts, latches, screws, rivets, pins, threads, or any combination thereof. The flanges 115A and 216 can be the same shape or different. The shape of the flanges 115A and 216 can include, but is not limited to, circular, square, rectangular, triangular, pentagonal, hexagonal, other regular polygonal shapes, non-regular polygonal shapes, or any other shape or combination thereof.

The second heat exchanger 100B can be disposed on or secured to the first heat exchanger 100A. For example, a second or "lower" end 101A of the first heat exchanger 100A can be disposed on or secured to a first or "upper" end 102B of the second heat exchanger 100B. A first or "upper" flange 115B on the first end 102B can be aligned with a second or "lower" flange 116A of the first heat exchanger 100A to aid in fastening of the two parts. For example, one or more fasteners can be used to secure the first flange 115B to the second flange 116A. The flanges 115B and 116A can be shaped the same or different. The shape of the flanges 115B and 116A can include, but is not limited to, circular, square, rectangular, triangular, pentagonal, hexagonal, other regular polygonal shapes, non-regular polygonal shapes, or any other shape or combination thereof.

The third heat exchanger 100C can be disposed on or secured to the second heat exchanger 100B. For example, a second or "lower" end 101B of the second heat exchanger 100B can be disposed on or secured to a first or "upper" end 102C of the third heat exchanger 100C. A first or "upper" flange 1150 on the first end 102C can be aligned with a second or "lower" flange 116B of the second heat exchanger 100B to aid in fastening of the two parts. For example, one or more fasteners can be used to secure the first flange 115C to the second flange 116B. The flanges 115C and 116B can be shaped the same or different. The shape of the flanges 115C and 116B can include, but is not limited to, circular, square, rectangular, triangular, pentagonal, hexagonal, other regular polygonal shapes, non-regular polygonal shapes, or any other shape or combination thereof.

A first diameter reducer 500 can be disposed on or secured to the third heat exchanger 100C. The first diameter reducer 500 can have a second or "lower" end 501 and a first or "upper" end 502 of a housing 510. The first end 502 of the first diameter reducer 500 can be disposed on or secured a first or "lower" end 101C of the third heat exchanger 100C. The first and second ends 502, 501 of the first diameter reducer 500 can include a first or "upper" flange 515 and a second or "lower" flange 516, respectively. The first flange 515 can be aligned with a second or "lower" flange 116C of the third heat exchanger 100C to aid in fastening of the third heat exchanger 100C to the first diameter reducer 500. For example, one or more fasteners can be used to secure the first flange 515 of the first diameter reducer 500 to the second flange 116C of the third heat exchanger 100C.

The diameter of the first diameter reducer 500 at the first end 502 can be from about 4 to about 5 times larger than the diameter of the second end 501. For example, the diameter of the first end 502 can range from a low of about 1.2 meters to a high of about 1.5 meters and the second end 501 can have a diameter ranging from about 0.2 meters to about 0.3 meters. The housing 510 can be shaped accommodate for the changing diameter. For example, the housing 510 can be, at least partially, cone or pyramid shaped.

The first diameter reducer 500 can include one or more aeration nozzles (two are shown 513, 514) disposed in a sidewall the housing 510. The aeration nozzles 513, 514 can be disposed at any angle with respect to the housing and/or the axial direction such that aeration nozzles can direct air, particles, and/or fluid toward the second end 501 of the first diameter reducer 500. For example, the aeration nozzles 513, 514 can be disposed at an angle from a low of about 30°, about 40°, or 50° to a high of about 70°, about 80°, or about 90° with respect to the axial direction. In another example, the aeration nozzles 513, 514 can be disposed at an angle of from about 35° to about 85° or from about 45° to about 75° from the axial direction. In yet another example, the aeration nozzles 513, 514 can be disposed at an angle of about 55°, about 60°, or about 65° from the axial direction.

Although not shown, the first diameter reducer 500 can have a plurality of aeration nozzles disposed circumferentially about the housing 510. For example, a first or "upper" row of aeration nozzles 513 and second or "lower" row of aeration nozzles 514 can be disposed in the housing 510. The first row of aeration nozzles 513 can be closer to the first end 502 of the first diameter reducer 500 than the second row of aeration nozzles 514. The aeration nozzles 513, 514 in the first and second row of aeration nozzles can be equally, or unequally spaced about the housing 510. The first row of aeration nozzles 513 can include more, less, or the same amount of nozzles as the second row of aeration nozzles 514. The first row of aeration nozzles 513 can include from two, three, or four to about six, eight, or ten aeration nozzles, and the second row of aeration nozzles 514 can include from two, three, or four to about six, eight, or ten aeration nozzles. For example, the first row of aeration nozzles 513 can include six aeration nozzles spaced 60° apart and the second row of aeration nozzles 514 can have four aeration nozzles spaced 90° apart. In another example, first row of aeration nozzles 513 can have six aeration nozzles spaced 60° apart and the second row of aeration nozzles 514 can have six aeration nozzles spaced 60° apart from each other and 30° apart from the closest aeration nozzles 513.

Although not shown, the aeration nozzles 513, 514 can have an internal projection inside the housing 510. The internal projection can, be a tube having one or more perforations at an end that is at least partially disposed inside the housing 510. The aeration nozzles 513, 514 can provide fluff air to get air and/or particulates flowing in though the heat exchange system 400.

A second diameter reducer 600 can be disposed on or secured to the first diameter reducer 500. The second diameter reducer 600 can have a housing 610 having first or "upper" end 602 and a second or "lower" end 601. The first end 602 of the second diameter reducer 600 can be disposed on or secured a second or "lower" end 501 of the first diameter reducer 500. The first end 602 of the second diameter reducer 600 can include a first flange 615. The first flange 615 can be aligned with a second or "lower" flange 516 of the first diameter reducer 500 to aid in fastening of the first diameter reducer 500 to the second diameter reducer 600. For example, one or more fasteners can be used to secure the first flange 615 of the second diameter reducer 600 to the second flange 516 of the first diameter reducer 500.

The second diameter reducer 600 can have one or, more pressure sensor openings 618 and/or one or more temperature sensor openings 619 disposed in or on the housing 610. One or more pressure sensors (not shown) can be at least partially disposed in the pressure sensor opening 618, and one or more temperature sensors (not shown) can be at least partially disposed in the temperature sensor opening 619. The pressure sensor opening 618 and the temperature sensor opening 619 can have the same or different angle with respect to an axial direction of the housing 610. For example, the pressure sensor opening 618 and/or the temperature sensor opening 619 can be disposed at an angle from a low of about 30°, about 40', or 50° to a high of about 70°, about 80°, or about 90° with respect to the axial direction of the housing 610. In another example, the pressure sensor opening 618 and the temperature sensor opening 619 can be disposed at an angle of from about 35° to about 85° or from about 45° to about 75° from the axial direction of the housing 610. In yet another example, the pressure sensor opening 618 and the temperature sensor opening 619 can be disposed at an angle of about 55°, about 60°, or about 65° from the axial direction of the housing 610. In yet another example, the pressure sensor opening 618 can be disposed at a 45° with respect to the axial direction of the housing 610 and the temperature sensor opening 619 can be disposed at a 90° with respect to the axial direction of the housing 610.

The second diameter reducer 600 can also have one or more solids outlets 680 disposed in a sidewall of the housing 610. Although not shown, a plurality of solids outlets 680 can be disposed in the sidewall of the housing 610. The solids outlet(s) 680 can have an internal projection into the interior of the housing 610 to provide separation between condensate on the sidewall 111 and particulates flowing through the housing 610. The solids outlet(s) 680 can be adapted to receive heated or cooled particulates, e.g., ash, therethrough.

A narrowing member 603 can be disposed at the second end 601 of the housing 610. The narrowing member 603 can be frustoconical or a cone, for example. The narrowing member can have a drain 625 disposed on narrowest end of the narrowing member 603 for excess water and/or condensate to leave the heat exchange system 400. Most of the condensate can develop during start-up of the heat exchange system 400. An aeration nozzle 617 can also be disposed on the drain 625 and/or the narrowing member to provide further air flow through the heat exchange system 400.

Particulates, e.g., ash, coming into the heat exchange system 400 can have a temperature ranging from a low of about 280° C., about 290° C., about 300° C., or about 310° C. to a high of about 420° C., about 430° C., about 440° C., or about 450° C. For example, the particulates coming into the heat exchange system 400 can have a temperature of from about 285° C. to about 445° C., about 295° C. to about 435° C., about 305° C. to about 425° C., or about 315° C. to about 370° C. In another example, particulates coming into the heat exchange system 400 can have a temperature of about 315° C. to about 330° C. The particulates coming into the heat exchange system 400 can be at the same pressure as that of the system, e.g., a gasification system, and can vary, from system to system. For example, the particulates can enter into the heat exchange system 400 at a pressure ranging from a low about 101 kPa, about 500 kPa, about 1,000 kPa, or about 1,500 kPa to a high of about 3,500 kPa, about 4,000 kPa, about 4,500, or about 5,000 kPa. In another example, the particulates can enter the heat exchange system 400 at a pressure of from about 250 kPa to about 4,750 kPa, about 750 kPa to about 4,250 kPa, or about 1,250 kPa to about 3,750 kPa.

Particulates coming out of the heat exchange system 400 can have a temperature ranging from a low of about 140° C., about 150° C., about 160° C., or about 170° C. to a high of about 180° C., about 190° C., about 200° C., or about 210° C. For example, the particulates coming out the heat exchange system 400 can have a temperature of from about 145° C. to about 205° C., about 155° C. to about 195° C., or about 165° C. to about 185° C. In another example, particulates coming out the heat exchange system 400 can have a temperature of about 175° C., about 176° C., or about 177° C.

In operation, the heat exchange system 400 can receive particulates, e.g., ash, through the particulate inlet port 200. Referring also to FIG. 1, a coolant, e.g., water, can be introduced to one or more of the inlets 120 disposed in the housing 110 of each heat exchanger 100A, 100B, 100C, prior to the particulates entering the particulate inlet port 200 or simultaneously. Although not shown, an external vessel can supply coolant to the inlet 120 and/or receive coolant from the outlet 130 via external piping. The coolant can pass from the inlet 120, through the inlet tube 123, to the inlet manifold 125. The inlet manifold 125 can distribute the coolant to the tubulars 155 and bends 156 of the coil 150. The coolant can then flow from the coil 150 to the outlet manifold 135, through the outlet tube 133, and out through the outlet 130 disposed in the sidewall 111 of the housing 110.

The particulates can pass from the particulate inlet port 200 through the first ends 102A, 102B, 102C end of each the one or more heat exchangers 100A, 100B, 100C, between and/or among the tubulars 155 and bends 156 of the coil 150 of each of the one or more heat exchangers 100A, 100B, 100C, and out through the second ends 101A, 101B, 101C. As the particulates flow through the heat exchanger 100A, 100B, 100C, heat can be indirectly transferred to the coolant to produce cooled particulates at and the second ends 101A, 101B, 101C and heated coolant at the outlets 130 of each heat exchanger 100A, 100B, 100C. The heated coolant can be recovered from the outlets 130 of the heat exchangers 100A, 100B, 100C and to another part of the system or process, e.g., steam drums and/or economizers.

The coolant can be introduced to the inlet 120 at any desired pressure. For example, the coolant can enter the inlet 120 of each heat exchanger 100A, 100B, 100C at a pressure matching the pressure in each of the heat exchangers 100A, 100B, 100C. This can help maintain the coolant at a desired velocity and/or reduce boiling of the coolant flowing through the coil 150, the inlet and outlet manifolds 125, 135, and/or the inlet and outlet tubes 123, 133. For example, the amount of coolant flowing into the inlet 120 can be sufficient to reduce or prevent the coolant from vaporizing within the coil 150. In another example, less than about 30%, less than about 20%, less than about 10%, less than about 5%, less than about 2%, or less than about 1% of the coolant can be vaporized. The coolant can enter the inlet 120 at a pressure ranging from a low of about 101 kPa, about 150 kPa, about 350 kPa, or about 700 kPa to a high of about 3,500 kPa, about 6,900 kPa, about 13,800 kPa, or about 20,000 kPa. The coolant can enter the inlet 120 at a temperature ranging from a low of about 15° C., about 30° C., about 60° C., about 90° C. to a high of about 175° C., about 250° C., about 300° C., or about 350° C. In another example, the coolant can enter the inlet 120 at a temperature of from about 20° C. to about 325° C., about 38° C. to about 275° C., or about 75° C. to about 200° C. Although pressure ranges and temperature ranges are indicated, the pressure and temperature of the cooling can vary widely depending on the pressure and temperature of particulates traveling through heat exchange system 400. The coolant recovered from the outlet 130 of each of the heat exchangers 100A, 100B, 100C can have an increased temperature compared to the temperature of the coolant entering through the inlet 120. For example, the coolant recovered from the outlet 130 can have a temperature ranging from about 0.5° C., about 1° C., about 5° C., or about 10° C. to a high of about 50° C., about 100° C., about 150° C., or about 200° C. more than the temperature of the coolant entering through the inlet 120.

The particulates can travel or flow through the heat exchangers 100A, 100B, 100C to the first diameter reducer 500. The aeration nozzles 513, 514 can be used, at least in part, to introduce air into the first diameter reducer 500 to help maintain a flow of particulates through the heat exchange system 400. The particulates can flow from the first diameter reducer 500 to the second diameter reducer 600. The particulates can flow through the second diameter reducer 600 to one or more of the solids outlets 680. For example, ash such as fine ash, coarse ash, or a combination thereof, can be cooled by the heat exchangers 100A, 100B, 100C and then flow out through the solids outlets 680.

The temperature and pressure of particulates can be measured as they, travel or flow through the housing 610 of the second diameter reducer. Based on this measured temperature and pressure, the amount of coils 150 used in each heat exchanger 100A, 100B, 100C can be adjusted to allow more or less cooling or heating. At least a portion of any condensate produced can flow through the narrowing member 603 to the drain 625.

During startup, air can be introduced to the aeration nozzles disposed in the housing 110 of the heat exchangers 100 and to the aeration nozzles 513, 514 of the first diameter reducer 500. As the heat increases in the heat exchange system 400 condensate can form on the inside of the housing 110 and can drain through the heat exchange system 400 to the drain 625 disposed at the end of the second diameter reduce 600.

Although not shown, a plurality of heat exchange systems 400 can be disposed on different parts of a system or process. For example, several heat exchange systems 400 can be used for the same process. In another example, the plurality of heat exchange systems 400 can be linked in parallel to have flexibility for varied heat exchanging requirements.

Figure 5:
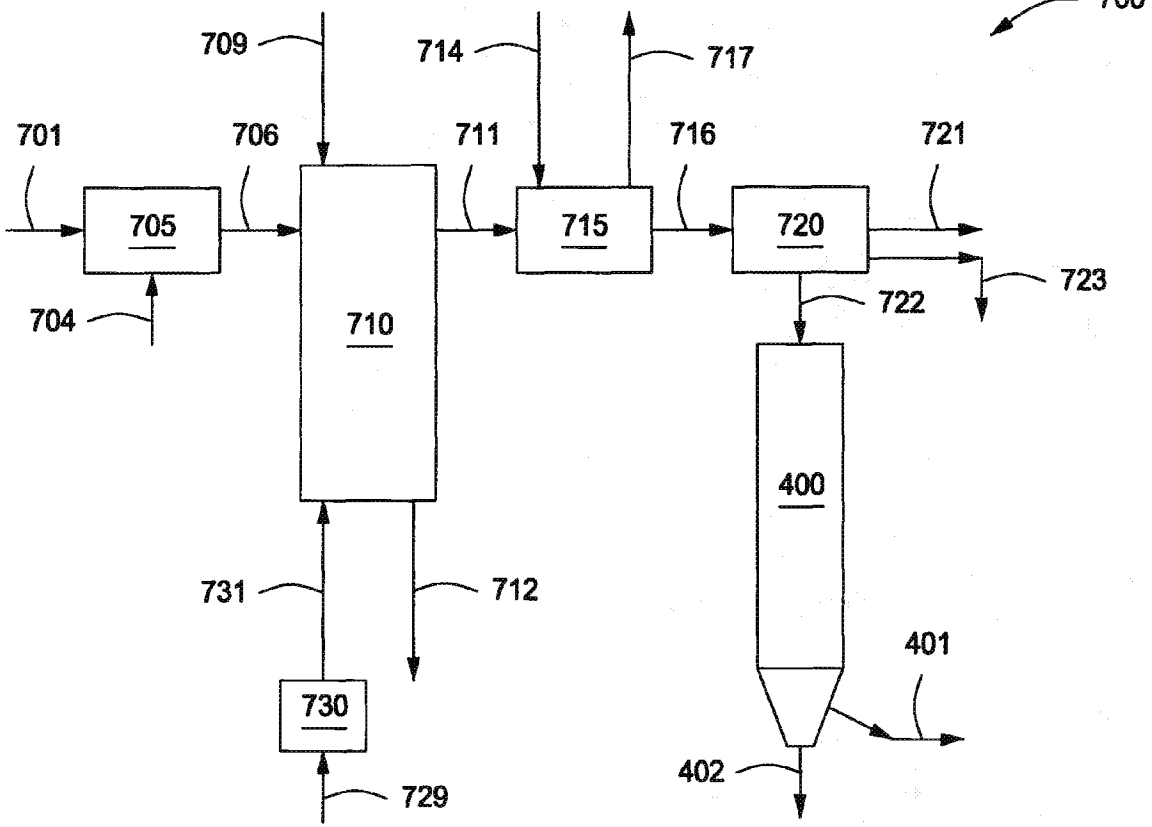
FIG. 5 depicts a schematic of an illustrative gasification system incorporating the heat exchange system depicted in FIG. 4, according to one or more embodiments described.

FIG. 5 depicts a schematic of an illustrative gasification system 700 incorporating the heat exchange system 400 depicted in FIG. 4, according to one or more embodiments. The gasification system 700 can include one or more hydrocarbon preparation units 705, a gasifiers 710, syngas coolers 715, particulate control devices 720, and heat exchange systems 400. A feedstock via line 701 can be introduced to the hydrocarbon preparation unit 705 to produce a gasifier feed via line 706. The feedstock via line 701 can include one or more carbonaceous material, whether solid, liquid, gas, or a combination thereof. The carbonaceous materials can include but are not limited to, biomass (e.g., plant and/or animal matter or plant and/or animal derived matter); coal (e.g., high-sodium and low-sodium lignite, lignite, sub-bituminous, and/or anthracite); oil shale; coke; tar; asphaltenes; low ash or no ash polymers; hydrocarbon-based polymeric materials; biomass derived material; or by-product derived from manufacturing operations. The hydrocarbon-based polymeric materials can include, for example, thermoplastics, elastomers, rubbers, including polypropylenes, polyethylenes, polystyrenes, including other polyolefins, homo polymers, copolymers, block copolymers, and blends thereof; PET (polyethylene terephthalate), poly blends, other polyolefins, poly-hydrocarbons containing oxygen; heavy hydrocarbon, sludge and bottoms products from petroleum refineries and petrochemical plants such as hydrocarbon waxes, blends thereof, derivatives thereof, and any combination thereof.

The feedstock via line 701 can include a mixture or combination of two or more carbonaceous materials. For example, the feedstock via line 701 can include a mixture or combination of two or more low ash or no ash polymers, biomass-derived materials, or by-products derived from manufacturing operations. In another example, the feedstock via line 701 can include one or more carbonaceous materials combined with one or more discarded consumer products, such as carpet and/or plastic automotive parts/components including bumpers and dashboards. Such discarded consumer products can be reduced in size to fit within the gasifier 710. Accordingly, the gasification system 700 can be useful for accommodating mandates for proper disposal of previously manufactured materials.

The hydrocarbon preparation unit 705 can be any preparation unit known in the art, depending on the feedstock via line 701 and the desired syngas product in line 721. For example, the hydrocarbon preparation unit 705 can remove contaminants from the feedstock via line 701 by washing away dirt or other undesired portions. The feedstock via line 701 can be a dry feed or can be conveyed to the hydrocarbon preparation unit 705 as a slurry or suspension. The feedstock via line 701 can be dried and then pulverized by one or more milling units (not shown) prior to being introduced to the hydrocarbon preparation unit 705. For example, the feedstock via line 701 can be dried from a high of about 35% moisture to a low of about 18% moisture. A fluid bed drier (not shown) can be used to dry the feedstock via line 701, for example. The feedstock via line 701 can have an average particle diameter size of from about 50 microns, about 150 microns, or about 250 microns to about 400 microns or about 500 microns or larger. The gasifier feed via line 706, one or more oxidants via line 731, and/or steam via line 709 can be introduced to the gasifier 710 to produce a raw syngas via line 711 and waste, e.g., coarse ash, via line 712.

The oxidant via line 731 can be supplied by an air separation unit 730 to the gasifier 710. The air separation unit 730 can provide pure oxygen, nearly pure oxygen, essentially oxygen, or oxygen-enriched air to the gasifier 710 via line 731. The air separation unit 730 can provide a nitrogen-lean, oxygen-rich feed to the gasifier 710 via line 731, thereby minimizing the nitrogen concentration in the raw syngas provided via line 711 to the syngas cooler 715. The use of a pure or nearly pure oxygen feed allows the gasifier 711 to produce a syngas that can be essentially nitrogen-free, e.g., containing less than about 0.5 mol % nitrogen/argon. The air separation unit 730 can be a high-pressure, cryogenic type separator. Air can be introduced to the air separation unit 730 via line 729. Although not shown, separated nitrogen from the air separation unit 730 can be introduced to a combustion turbine. The air separation unit 730 can provide from about 10%, about 30%, about 50%, about 70%, about 90%, or about 100% of the total oxidant introduced to the gasifier 710.

Although not shown, one or more sorbents can be added to the gasifier 710. The one or more sorbents can be added to capture contaminants from the raw syngas, such as sodium vapor in the gas phase within the gasifier 710. The one or more sorbents can be added to scavenge oxygen at a rate and level sufficient to delay or prevent the oxygen from reaching a concentration that can result in undesirable side reactions with hydrogen (e.g., water) from the feedstock within the gasifier 710. The one or more sorbents can be mixed or otherwise added to the one or more hydrocarbons. The one or more sorbents can be used to dust or coat the feedstock particles in the gasifier 710 to reduce the tendency for the particles to agglomerate. The one or more sorbents can be ground to an average particle size of about 5 microns to about 100 microns, or about 10 microns to about 75 microns. Illustrative sorbents can include but are not limited to, carbon-rich ash, limestone, dolomite, and coke breeze. Residual sulfur released from the feedstock can be captured by native calcium in the feed or by a calcium-based sorbent to form calcium sulfide.

The gasifier 710 can be one or more circulating solid or transport gasifier, one or more counter-current fixed bed gasifier, one or more co-current fixed bed gasifier, one or more fluidized bed reactor, one or more entrained flow gasifier, any other type of gasifier, or any combination thereof. Circulating solid or transport gasifiers operate by introducing the gasifier feed via line 141 and introducing one or more oxidants to one or more mixing zones (not shown) to provide a gas mixture. An exemplary circulating solid gasifier is discussed and described in U.S. Pat. No. 7,722,690.

The gasifier 710 can produce a raw syngas via line 711, while waste from the gasifier 710, e.g., ash or coarse ash, can be removed via line 712. The waste or ash removed via line 712 can be larger in size than the fine ash via line 722. The waste or ash via line 712 can be disposed of or can be used in other applications. Although not shown, the ash in line 712 can be introduced to the heat exchange 400 with the fine ash in lie 712. Although not shown, in another example, the coarse ash via line 712 can be introduced to another or separate heat exchange system 400. Steam via line 709 can be introduced to the gasifier 710 to support the gasification process. In one or more embodiments, however, the gasifier 710 may not require direct steam introduction via line 709.

The raw syngas via line 711 produced in the gasifier 710 can include carbon monoxide, hydrogen, oxygen, methane, carbon dioxide, hydrocarbons, sulfur, solids, mixtures thereof, derivatives thereof, or combinations thereof. The raw syngas via line 711 can contain 85% or more carbon monoxide and hydrogen with the balance being primarily carbon dioxide and methane. The gasifier 710 can convert at least about 85%, about 90%, about 95%, about 98%, or about 99% of the carbon from the gasifier feed via line 706 to syngas.

The raw syngas via line 711 can contain 90% or more carbon monoxide and hydrogen, 95% or more carbon monoxide and hydrogen, 97% or more carbon monoxide and hydrogen, or 99% or more carbon monoxide and hydrogen. The carbon monoxide content of the raw syngas via line 711 produced in the gasifier 710 can range from a low of about 10 vol %, about 20 vol %, or about 30 vol % to a high of about 60 vol %, about 70 vol %, about 80 vol %, or about 90 vol %. For example, carbon monoxide content of the raw syngas via line 711 can range from about 15 vol % to about 85 vol %, about 25 vol % to about 75 vol %, or about 35 vol % to about 65 vol %.

The hydrogen content of the raw syngas via line 711 can range from a low of about 1 vol %, about 5 vol %, or about 10 vol % to a high of about 30 vol %, about 40 vol %, or about 50 vol %. For example, the hydrogen content of the raw syngas via line 711 can range from about 5 vol % to about 45 vol % hydrogen, from about 10 vol % to about 35 vol % hydrogen, or from about 10 vol % to about 25 vol % hydrogen.

The raw syngas via line 711 can contain less than 25 vol %, less than 20 vol %, less than 15 vol %, less than 10 vol %, or less than 5 vol %, of combined nitrogen, methane, carbon dioxide, water, hydrogen sulfide, and hydrogen chloride.

The nitrogen content of the raw syngas via line 711 can range from a low of about 0 vol %, about 0.5 vol %, about 1.0 vol %, or about 1.5 vol % to a high of about 2.0 vol %, about 2.5 vol %, or about 3.0 vol %. The raw syngas via line 711 can be nitrogen-free or essentially nitrogen-free, e.g., containing 0.5 vol % nitrogen or less.

The methane content of the raw syngas via line 711 can range from a low of about 0 vol %, about 2 vol %, or about 5 vol % to a high of about 10 vol %, about 15 vol %, or about 20 vol %. For example, the methane content of the raw syngas via line 711 can range from about 1 vol % to about 20 vol %, from about 5 vol % to about 15 vol %, or from about 5 vol % to about 10 vol %. In another example, the methane content of the raw syngas via line 711 can be about 15 vol % or less, 10 vol % or less, 5 vol % or less, 3 vol % or less, 2 vol % or less, or 1 vol % or less.

The carbon dioxide content of raw syngas via line 711 can range from a low of about 0 vol %, about 5 vol %, or about 10 vol % to a high of about 20 vol %, about 25 vol %, or about 30 vol %. For example, the carbon dioxide content of raw syngas via line 711 can be about 20 vol % or less, about 15 vol % or less, about 10 vol % or less, about 5 vol % or less, or about 1 vol % or less.

The water content of the raw syngas via line 711 can be about 40 vol % or less, 30 vol % or less, 25 vol % or less, 20 vol % or less, 15 vol % or less, 10 vol % or less, 5 vol % or less, 3 vol % or less, 2 vol % or less, or 1 vol % or less.

The raw syngas via line 711 leaving the gasifier 710 can have a heating value, corrected for heat losses and dilution effects, of about 1,863 kJ/m$^3$ (50 Btu/scf) to about 2,794 kJ/m$^3$ (75 Btu/scf); about 1,863 kJ/m$^3$ to about 3,726 kJ/m$^3$ (100 Btu/scf); about 1,863 kJ/m$^3$ to about 4,098 kJ/m$^3$ (110 Btu/scf); about 1,863 kJ/m$^3$ to about 5,516 kJ/m$^3$ (140 Btu/scf); about 1,863 kJ/m$^3$ to about 6,707 kJ/$^3$ (180 Btu/scf); about 1,863 kJ/m$^3$ to about 7,452 kJ/m$^3$ (200 Btu/scf); about 1,863 kJ/m$^3$ to about 9,315 kJ/m$^3$ (250 Btu/scf); about 1,863 kJ/m$^3$ to about 10,246 kJ/m$^3$ (275 Btu/scf), 1,863 kJ/m$^3$ to about 11,178 kJ/m$^3$ (300 Btu/scf), or about 1,863 kJ/m$^3$ to about 14,904 kJ/m$^3$ (400 Btu/scf).

The raw syngas via line 711 can exit the gasifier 710 at a temperature ranging from about 575° C. to about 2,100° C. For example, the raw syngas via line 711 can have a temperature ranging from a low of about 800° C., about 900° C., about 1,000° C., or about 1,050° C. to a high of about 1,150° C., about 1,250° C., about 1,350° C., or about 1,450° C.

The raw syngas via line 711 can be introduced to the syngas cooler 715 to provide a cooled syngas via line 716. The raw syngas via line 711 can be cooled in the syngas cooler 715 using a heat transfer medium introduced via line 714. For example, the raw syngas via line 711 can be cooled by indirect heat exchange of from about 260° C. to about 430° C. Although not shown, the heat transfer medium via line 714 can include process steam or condensate from syngas purification systems. The heat transfer medium via line 714 can be process water, boiler feed water, superheated low-pressure steam, superheated medium pressure steam, superheated high-pressure steam, saturated low-pressure steam, saturated medium pressure steam, saturated high-pressure steam, and the like. Heat from the raw syngas introduced via line 711 to the syngas cooler 715 can be indirectly transferred to the heat transfer medium introduced via line 714. For example, heat from the raw syngas introduced via line 714 to the syngas cooler 715 can be indirectly transferred to boiler feed water introduced via line 714 to provide superheated high pressure steam via line 717. The superheated or high pressure superheated steam via line 717 can be used to power one or more steam turbines (not shown) that can drive a directly coupled electric generator (not shown). Condensate recovered from the steam turbines (not shown) can then be recycled as the heat transfer medium via line 714, e.g., boiler feed water, to syngas cooler 715.

The superheated or high pressure superheated steam via line 717 from the syngas cooler 715 can be at a temperature ranging from a low of about 300° C., about 325° C., about 350° C., about 370° C., about 390° C., about 415° C., about 425° C., or about 435° C. to a high of about 440° C., about 445° C., about 450° C., about 455° C., about 460° C., about 470° C., about 500° C., about 550° C., about 600° C., or about 650° C. For example, the superheated or high pressure superheated steam via line 717 can be at a temperature of from about 427° C. to about 454° C., about 415° C. to about 433° C., about 430° C. to about 460° C., or about 420° C. to about 455° C. The superheated or high pressure superheated steam via line 717 can be at a pressure ranging from a low of about 3,000 kPa, about 3,500 kPa, about 4,000 kPa, or about 4,300 kPa to a high of about 4,700 kPa, about 5,000 kPa, about 5,300 kPa, about 5,500 kPa, about 6,000 kPa, or about 6,500 kPa. For example, the superheated or high pressure superheated steam via line 717 can be at a pressure of from about 3,550 kPa to about 5,620 kPa, about 3,100 kPa to about 4,400 kPa, about 4,300 kPa to about 5,700 kPa, or about 3,700 kPa to about 5,200.

Although not shown, the syngas cooler 711 can include one or more heat exchangers or heat exchanging zones arranged in parallel or in series. The heat exchangers included in the syngas cooler 711 can be shell-and-tube type heat exchangers. For example, the raw syngas via line 711 can be supplied in series or parallel to the shell-side or tube-side of the heat exchangers. The heat transfer medium via line 714 can pass through either the shell-side or tube-side, depending on which side the raw syngas is introduced.

The cooled syngas via, line 716 can be introduced to the one or more particulate removal systems 720 to partially or completely remove, particulates from the cooled syngas via line 716 to provide a separated or "particulate-lean" syngas via line 721, separated particulates via line 722, and condensate via line 723. Although not shown, steam can be supplied during startup to the particulate removal system 720.

Although not shown, the one or more particulate removal systems 720 can optionally be used to partially or completely remove particulates from the raw syngas via line 711 before cooling. For example, the raw syngas via line 711 can be introduced directly to the particulate removal system 720, resulting in hot gas particulate removal (e.g., from about 550° C. to about 1,050° C.). Although not shown, two particulate removal systems 720 can be used. For example, one particulate removal system 720 can be upstream of the syngas cooler 715 and one particulate removal system 720 can be downstream of the syngas cooler 715.

The one or more particulate removal systems 720 can include one or more separation devices such as conventional disengagers and/or cyclones (not shown). Particulate control devices ("PCD") capable of providing an outlet particulate concentration below the detectable limit of about 0.1 ppmw can also be, used. Illustrative PCDs can include, but are not limited to, sintered metal filters, metal filter candles, and/or ceramic filter candles (for example, iron aluminide filter material). A small amount of high-pressure recycled syngas can be used to pulse-clean the filters as they accumulate particles from the unfiltered syngas.

The separated particulates via line 722 can be introduced to the heat exchange system 400 to produce cooled particulates via line 401 and condensate via line 402. The separated particulates via line 722 and/or the cooled particulates via line 401 can have a particle diameter size of about 20 microns or less, about 15 microns or less, about 12 microns or less, or about 9 microns or less. Although not shown, one or more heat exchange systems 400 can be joined to the same particulate removal system 720 or to multiple particulate removal systems 720. For example, four heat exchange systems 400 can be linked in parallel to each other and to the particulate removal system 720.

Embodiments of the present disclosure further relate to any one or more of the following paragraphs:

1. A heat exchanger, comprising: one or more coils at least partially disposed within a cylindrical housing, the one or more coils comprising a plurality of tubulars connected by return bends disposed at one or more ends thereof; and a support grid at least partially disposed within the housing and secured to one or more inner surfaces of one or more sidewalls thereof, the support grid comprising: a plurality of cross members formed of a series of concentric cylinders connected together by a plurality of radially disposed gussets, wherein an outermost concentric cylinder is disposed proximate the one or more inner surfaces of the one or more sidewalls, and wherein at least one of the one or more coils is secured to at least one of the cross members, at least one of the gussets, or both; and one or more beams having a first end and a second end fastened to different points on the one or more inner surfaces of the one or more sidewalls, wherein the cross members are disposed on at least one of the one or more beams.

2. The heat exchanger of paragraph 1, further comprising: an inlet and an outlet disposed through the one or more sidewalls of the housing; an inlet manifold at least partially disposed within the housing and in fluid communication with the inlet; and an outlet manifold at least partially disposed within the housing and in fluid communication with the outlet, wherein the one or more coils comprise an inner portion and an outer portion, and wherein the inner portion and the outer portion are each independently in fluid communication with the inlet manifold and the outlet manifold.

3. The heat exchanger of paragraph 2, wherein the outer portion is concentrically disposed about the inner portion.

4. The heat exchanger of paragraph 3, wherein the inner portion is concentrically disposed about the inlet manifold and the outlet manifold.

5. The heat exchanger according to any one of paragraphs 2 to 4, further comprising an inlet pipe in fluid communication with the inlet and an outlet pipe in fluid communication with the outlet, wherein the inlet manifold is at least partially disposed on the inlet pipe, and wherein the outlet manifold is at least partially disposed on the outlet pipe.

6. The heat exchanger of paragraph 5, wherein the inlet pipe and the outlet pipe each have a curved portion, wherein the curved portion of the inlet pipe is disposed between the inlet and the inlet manifold, and wherein the curved portion of the outlet pipe is disposed between the outlet and the outlet manifold.

7. The heat exchanger according to any one of paragraphs 2 to 6, wherein the inlet and the outlet are in fluid communication with an external vessel via external piping.

8. The heat exchanger according to any one of paragraphs 1 to 7, wherein the tubulars are axially oriented with respect to a longitudinal axis of the housing and are substantially straight.

9. The heat exchanger according to any one of paragraphs 1 to 8, further comprising one or more aeration nozzles disposed on the one or more sidewalls of the housing.

10. The heat exchanger of paragraph 9, further comprising one or more aeration tubes disposed proximate the one or more beams and in fluid communication with the one or more aeration nozzles.

11. The heat exchanger according to any one of paragraphs 1 to 10, wherein at least one of the return bends is secured to at least one of the cross members, at least one of the gussets, or both via one or more support rods.

12. A system for cooling particulates, comprising: two or more interconnected heat exchangers, each heat exchanger comprising: a cylindrical housing having a first end adapted to receive particulates and a second end adapted to dispense the particulates; an inlet and an outlet at least partially disposed through a sidewall of the cylindrical housing, wherein the inlet is adapted to receive a coolant; an inlet pipe disposed in fluid communication with the inlet; an outlet pipe disposed in fluid communication with the outlet; an inlet manifold at least partially disposed within the housing and in fluid communication with the inlet pipe; an outlet manifold at least partially disposed within the housing and in fluid communication with the outlet pipe; one or more coils at least partially disposed within the housing and in fluid communication with the inlet manifold and the outlet manifold, the one or more coils comprising a plurality of tubulars axially oriented with respect to a longitudinal axis of the housing and connected by return bends disposed at one or more ends thereof; and a first support at least partially disposed within the housing and secured to an inner surface of the sidewall, to at least one of the one or more coils, wherein the first support comprises: a grid formed by a plurality of concentric cylinders connected by a plurality of radially disposed gussets, wherein two or more grid clips are attached to an outermost cylinder of the grid and are disposed on two or more housing clips secured to the inner surface of the sidewall of the housing; a plurality of support rods each having a first end secured to the grid and a second end secured to at least one of the return bends; and one or more beams having a first end and a second end disposed at different points on the inner surface of the sidewall, wherein the grid is disposed on at least one beam.

13. The system of paragraph 12, further comprising: an inlet port comprising a first end adapted to receive particulates, wherein at least one of the two or more heat exchangers is disposed on a second end of the inlet port; a first diameter reducer comprising a first end disposed on a second end of at least one of the two or more heat exchangers; and a second diameter reducer comprising a first end disposed on a second end of the first diameter reducer.

14. The system of paragraph 12 or 13, wherein each heat exchanger further comprises a second support, wherein the first support is at least partially disposed within the housing proximate the inlet and the outlet and the second support is at least partially disposed within the housing proximate the first end of the housing and secured to at least one of the one or more coils.

15. The system according to any one of paragraphs 12 to 14, wherein the two or more heat exchangers each have at least one end joined to another end of a different heat exchanger.

16. The system according to any one of paragraphs 12 to 15, wherein the first diameter reducer further comprises a plurality of aeration nozzles.

17. A method for cooling particulates, comprising: introducing particulates to a first end of a heat exchanger, the heat exchanger comprising: an inlet and an outlet disposed through one or more sidewalls of a housing; one or more coils at least partially disposed within the housing and in fluid communication with the inlet and the outlet, the one or more coils comprising a plurality of tubulars connected by return bends disposed at one or more ends thereof; and a support grid at least partially disposed within the housing and secured to one or more inner surfaces of one or more sidewalls thereof, the support grid comprising: a plurality of cross members formed of a series of concentric cylinders connected together by a plurality of radially disposed gussets, wherein an outermost concentric cylinder is disposed proximate the one or more inner surfaces of the one or more sidewalls, and wherein at least one of the one or more coils is secured to at least one of the cross members, at least one of the gussets, or both; and one or more beams having a first end and a second end fastened to different points on the one or more inner surfaces of the one or more sidewalls, wherein the cross members are disposed on at least one of the one or more beams; introducing a coolant to the coils through the inlet; flowing the particulates through the heat exchanger; recovering a coolant from the outlet; and producing cooled particulates at a second end of the heat exchanger.

18. The method of paragraph 17, further comprising producing particulates in a gasifier; and introducing the particulates from the gasifier to the first end of the heat exchanger, wherein the particulates comprise fine ash, coarse ash, or a combination thereof.

19. The method of claim 17, further comprising: introducing the cooled particulates from the second end of the heat exchanger into a first end of a first diameter reducer; and inducing particulate flow through the heat exchanger and the first diameter reducer by introducing one or more fluids through one or more aeration nozzles disposed in a sidewall of the first diameter reducer, wherein the first end of the first diameter reducer has a larger diameter than a second end of the first diameter reducer.

20. The method of claim 19, further comprising: introducing particulates from the first diameter reducer to a first end of a second diameter reducer; removing condensate from a sidewall of the second diameter reducer with one or more drain nozzles disposed at a second end of the second diameter reducer; and removing the cooled particulates from the second diameter reducer.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the disclosure may be devised without departing from the basic scope thereof, and the scope thereof is determined by the claims that follow.

What is claimed is:

1. A heat exchanger, comprising:

a cylindrical housing;

one or more coils at least partially disposed within the cylindrical housing, the one or more coils comprising a plurality of vertical tubulars, a lower return bend connecting the lower ends of two adjoining tubulars, and an upper return bend connecting the upper ends of two adjoining tubulars;

a first support grid connected to the lower return bends;

a second support grid connected to the upper return bends, wherein the first and second support grids are at least partially disposed within the housing and secured therein, the support grids each comprising a plurality of concentric cylinders connected together by a plurality of gussets that are radially disposed along one plane, wherein an outermost concentric cylinder is disposed proximate the cylindrical housing and wherein at least one of the plurality of cylinders is concentrically disposed inside the outermost cylinder; and one or more beams disposed beneath the lower return bends of the tubulars and having a first end fastened to the cylindrical housing at a first location and a second end fastened to the cylindrical housing at a second location, wherein the first support grid is supported by at least one of the one or more beams.

2. The heat exchanger of claim 1, further comprising:

an inlet and an outlet disposed through the cylindrical housing;

an inlet manifold at least partially disposed within the cylindrical housing and in fluid communication with the inlet; and an outlet manifold at least partially disposed within the cylindrical housing and in fluid communication with the outlet, wherein the one or more coils comprise an inner coil and an outer coil, and wherein the inner coil and the outer coil are each independently in fluid communication with the inlet manifold and the outlet manifold.

3. The heat exchanger of claim 2, wherein the outer coil is concentrically disposed about the inner coil, and wherein the inner coil is concentrically disposed about the inlet manifold and the outlet manifold.

4. The heat exchanger of claim 2, further comprising an inlet pipe in fluid communication with the inlet and an outlet pipe in fluid communication with the outlet, wherein the inlet manifold is at least partially disposed on the inlet pipe, and wherein the outlet manifold is at least partially disposed on the outlet pipe.

5. The heat exchanger of claim 4, wherein the inlet pipe and the outlet pipe each have a curved portion, wherein the curved portion of the inlet pipe is disposed between the inlet and the inlet manifold, and wherein the curved portion of the outlet pipe is disposed between the outlet and the outlet manifold.

6. The heat exchanger of claim 1, wherein the vertical tubulars are axially oriented with respect to a longitudinal axis of the housing and are substantially straight, wherein a plurality of gaps are formed between the vertical tubulars, wherein the gaps are configured to provide a flow path for solid particulates to flow between the vertical tubulars, and wherein the vertical tubulars are configured to cool the particulates.

7. The heat exchanger of claim 1, further comprising one or more aeration nozzles disposed on the cylindrical housing, wherein the one or more aeration nozzles are configured to introduce a fluid into the heat exchanger.

8. The heat exchanger of claim 1, wherein the lower return bend is secured to the first support grid via one or more support rods, and wherein the upper return bend is secured to the second support grid via one or more support rods.

9. The heat exchanger of claim 1, wherein the plurality of cylinders are disposed along a length of and between ends of at least one of the plurality of gussets.

10. The heat exchanger of claim 9, wherein the plurality of concentric cylinders connects the one or more coils to the plurality of gussets.

11. The heat exchanger of claim 10, wherein the plurality of gussets connects the plurality of concentric cylinders to the cylindrical housing.

* * * * *